US005664857A

United States Patent [19]

Lautenschläger et al.

[11] Patent Number: 5,664,857

[45] Date of Patent: Sep. 9, 1997

[54] METAL FITTING HOLDER FOR FRONT FACES OF DRAWERS

[75] Inventors: Horst Lautenschläger, Reinheim; Gerhard Wilhelm Lautenschläger, Brensbach-Wersau, both of Germany

[73] Assignee: Mepla-Werke Lautenschläger GmbH & Co. KG, Germany

[21] Appl. No.: 681,287

[22] Filed: Jul. 22, 1996

[30] Foreign Application Priority Data

Aug. 29, 1995 [DE] Germany ..... 195 31 698.3

[51] Int. Cl.[6] ..... A47B 88/00

[52] U.S. Cl. ..... 312/348.4; 312/348.1; 312/330.1

[58] Field of Search ..... 312/348.1, 348.2, 312/348.4, 263, 330.1

[56] References Cited

U.S. PATENT DOCUMENTS

| | | | |
|---|---|---|---|
| 4,995,683 | 2/1991 | Albiez | 312/348.4 |
| 5,281,022 | 1/1994 | Rock | 312/348.4 |
| 5,460,443 | 10/1995 | Ferrari et al. | 312/348.4 |

FOREIGN PATENT DOCUMENTS

| | | | |
|---|---|---|---|
| 0636327 | 9/1993 | European Pat. Off. . | |
| 3801103 | 7/1994 | Germany . | |
| 9419610 | 3/1995 | Germany . | |
| 2182546 | 5/1987 | United Kingdom | 312/348.4 |

*Primary Examiner*—Peter M. Cuomo
*Assistant Examiner*—James O. Hansen
*Attorney, Agent, or Firm*—Londa and Traub

[57] ABSTRACT

A metal fitting (10) for holding a front face (12) of a drawer at its side walls (16). The metal fitting is composed of a holding part (14), which is to be fastened to the surface of the front face (12) on the inner side of the drawer, and of a receiving part (18) at each side wall of the drawer. An extended, bracket-like projection (24), protruding from the side of the holding part (14) averted from the front face, can be introduced into the receiving part (18) and can be locked detachably by a locking element (46) in the holding part (14), which locking element (46) is acted upon by a spring under tension and can be swiveled between two stable end positions

9 Claims, 4 Drawing Sheets

Fig.4
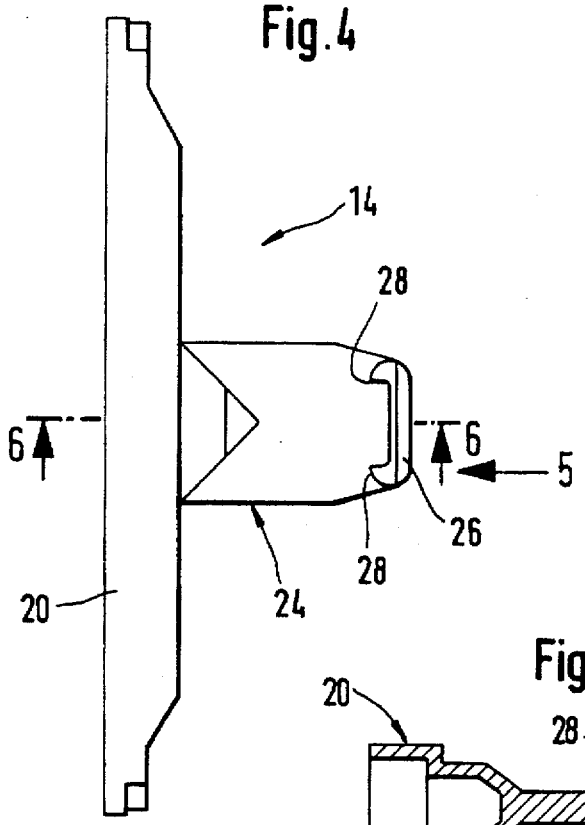
Fig.5
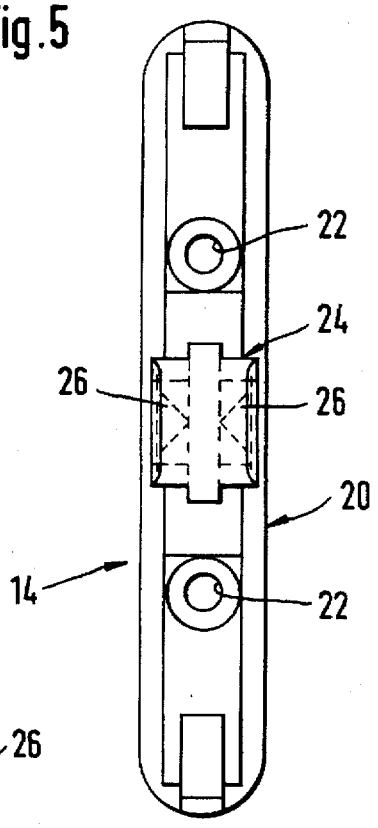
Fig.6
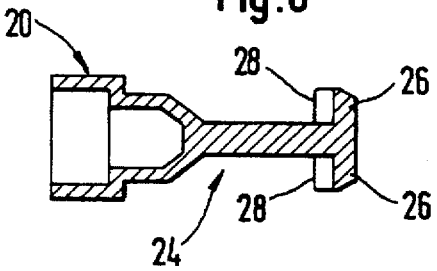
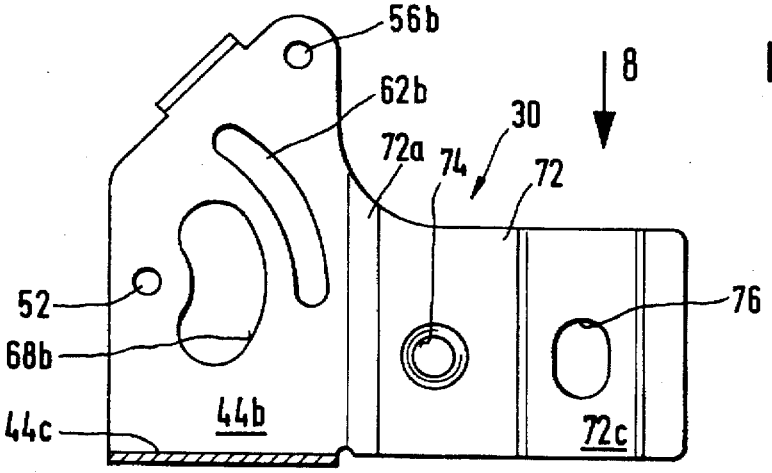
Fig.7
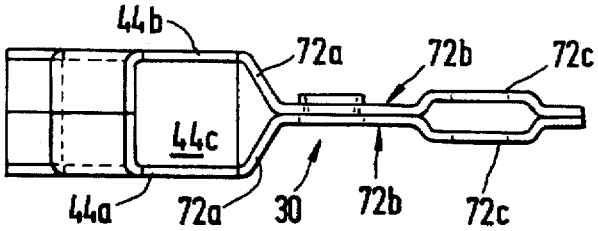
Fig.8

METAL FITTING HOLDER FOR FRONT FACES OF DRAWERS

BACKGROUND OF THE INVENTION

The invention relates to a metal fitting for holding a front face of a drawer at its side walls, with a holding part, which is to be fastened to the surface of the front face on the inner side of the drawer, and a receiving part at each side wall of the drawer, which is to be fastened at or in the side wall of the drawer, for which an extended bracket-like projection, protruding from the side of the holding part averted from the front face, can be introduced into the receiving part and can be locked detachably by a locking element in the holding part, which locking element is acted upon by a spring under tension and can be swiveled between two stable end positions.

At the visible front side, drawers are provided at the present time predominantly with front faces, which protrude beyond the actual height and width dimensions of the drawer box and thus in the position in which they are pushed completely into the furniture carcass—corresponding to opening door leaves—rest laterally and, in the case of the top and bottom drawers of a cabinet or chest of drawers, also with the protruding upper or lower edge region on the front ends of the carcass walls. In this connection, the problem arises that the front faces must be aligned in such a manner to adjacent drawers, above, below or at the side, and/or to the side walls of the cabinet, cupboard or wardrobe or to adjacent door leaves, that they have an esthetically pleasing, exact alignment in the closed state. As long as the front faces were placed on the actual front walls of the drawers and screwed to this, such an alignment was relatively simple owing to the fact that the borehole for the fastening screws, screwed from the inside of the drawers through the front wall of the drawers, were dimensioned larger in the front wall than was the diameter of the shaft of the fastening screws, so that, when the fastening screws were loosened, the front face could be shifted in all directions within the limits specified by the overdimensioning of the boreholes. After the alignment, the front faces were then fixed to the front wall of the drawers by tightening the fastening screws. In recent times, however, drawers have been produced increasingly without a fixed front wall, that is, the front faces at the same time represent the front wall and must therefore be rigidly connectable with the drawer box, in order to stabilize the drawer in its front region. On the other hand, it must be nevertheless possible to make the alignment described. For this purpose, metal fitting holders have been developed which, for example, additionally assume the task of holding the front end of the runner of the pull-out guide, which supports the drawer, so that it can be pulled out of the cabinet, cupboard or wardrobe carcass (German Offenlegungsschrift 36 32 442). These metal fitting holders are disposed under the bottom of the drawer on the inner surface of the side walls protruding downward over the bottom. However, for fixing the front face sufficiently rigidly to the side walls, additional fastening means, in the form of comer connectors, must then be provided above the level of the bottom at least in the case of drawers of large vertical height. These corner connectors must also permit the front face to be adjusted and, furthermore, appear optically only as little as possible. Therefore, for drawers with side walls of plastic or hollow metal sections, used for particular applications, metal fastening fittings, disposed in the interior of the hollow sections of the side walls, were developed for front faces (German Offenlegungsschift 39 31 155), for which a holding part, which can be introduced into a receiving part that can be fixed adjustably in the cavity of the side walls, and locked there, can be fixed to the front face. The locking is accomplished, for example, by means of a hasp with a locking surface, which extends spirally or eccentrically and can be rotated by means of a tool, such as a screwdriver, in such a manner that it can be rotated from a position, which enables the protruding bracket of the holding part to be pushed in, into a locking position, in which the spiral locking surface embraces a projection at the bracket holding part. Due to the eccentric spiral course of the locking surface, tightening is produced by rotating the hasp. Due to this tightening, the front face is pulled firmly against the front end surfaces of the drawer side walls. At the same time, certain tolerance differences can be compensated for, particularly since the receiving part in turn is disposed in the side wall of the drawer so that it can be adjusted in the transverse direction, the pull-out direction of the drawer, as well as in the vertical direction. The known front face metal holding fitting has been entirely satisfactory. Because of its complex construction, the metal fitting is relatively expensive to manufacture. Moreover, the locking of the holding part in the receiving part by actuating the locking element by means of a tool harbors the danger that, when installed by untrained personnel or subsequently adjusted by a private person, the locking bar no longer is tightened sufficiently firmly and the front face can then become loose and be shifted once again. This danger does not exist if the metal holding fitting is constructed in the initially mentioned manner (European publication 0 636 327) in such a manner, that the actual locking bar element can be swiveled between two end positions and is acted upon by a spring under tension, which is disposed in such a manner, that the locking element is bistable, that is, when the locking element is introduced, it is swiveled from the one stable end position, in which the holding part can be introduced, into the receiving part and this locking element then, after passing through a dead center position, automatically snaps into the locking position and, at the same time, carries along a hook, which is provided at the holding part and engages a recess in the locking element. The tension on the spring presses the front face against the front end surfaces of the side walls. By exerting a tensile force on the front face, which is larger than the tension on the spring, the holding part can, however, be pulled back out of the receiving part. In other words, the spring must be installed with a high tension, so that the front face cannot accidentally pop off when the drawer, for example, is closed with momentum and the front face jerks against the carcass of the cabinet, cupboard or wardrobe.

SUMMARY OF THE INVENTION

It is therefore an object of the invention to provide a metal holding fitting for front faces of drawers, which enables the holding part, introduced into the receiving part, to be locked automatically, after the locking, however, it being impossible to dismantle the front face from the side walls by pulling, that is, a rigid, impact and vibration resistant connection is obtained.

Starting out from a metal fitting of the initially mentioned type, this objective is accomplished pursuant to the invention owing to the fact that, in its region facing the front face, the locking element is mounted in such a manner that it can be swiveled in the receiving part about an axis, which is disposed above or below the horizontal boundary of the bracket-like projection of the holding part and extends transversely to the pushing in direction of the projection and is provided in its end region, averted from the holding part, with at least one locking edge which, as a result of the pretension, is swiveled into the first end position in the specified mounting position of the front face at the drawer side walls behind a holding edge, which is formed in the region of the front end of the bracket-like projection and points rearward to the front face, and in that the locking element has a limiting edge, which adjoins one edge of the locking edge, protrudes in the first end position of the locking element into the insertion path of the bracket-shaped projection and extends obliquely to the insertion direction and with which the free end of the bracket-shaped projection collides during the introduction into the receiving part and swivels the locking element against the spring under tension in the direction of the second stable end position, and in that the locking edge of the locking element, while being swiveled in behind the holding edge of the bracket-shaped projection, has an increasingly greater distance from the axis of rotation of the locking element in the region of contact with the holding edge. The locking thus takes place here not due to the spring, which attempts to rotate the locking element further, but due to the contact between the locking edge of the locking element and the holding edge of the bracket-shaped projection, that is, by positive locking.

In a preferred embodiment of the invention, the locking edge of the locking element has an arched course, the radius, measured from the axis of rotation of the locking element to the locking edge, increasing gradually from the end, which at first grips behind the holding edge during the locking process, in the direction of the other end. By these means, a tightening is achieved, which compensates for the inaccuracies during the installation of the metal fitting or the tolerances in the metal fitting parts themselves.

At its end averted from the front face, the bracket-like projection can have holding lugs on both sides, which protrude in opposite directions and on which in each case holding edges for the locking element are constructed, in which case then the locking element has two panel-shaped locking element halves of the same outer boundary, which are disposed parallel to and at a distance from one another and thus has two locking edges, which follow the same course and the clear distance from one another of which is at least equal to and preferably somewhat larger than the thickness of the bracket-shaped projection, but smaller than the distance measured over the opposite, free, boundary edges of the holding lugs. The locking force, distributed over two locking element halves, is thus transferred symmetrically, on both sides, into the bracket-like projection.

In an appropriate, further development of the invention, the receiving part has, in its from face end region, two panel-shaped walls, which are disposed parallel to and at a distance from one another and the clear distance from one another of which is at least equal to or somewhat greater than distance measured over the opposite, free boundary edges of the holding lugs of the lug-shaped projection, the panel-shaped walls being connected together at their underside by a transverse wall, which is provided to guide the bracket-shaped projection, and the locking element being mounted pivotably in the space between the parallel walls by a hinge pin, which passes through flush boreholes in the parallel walls and the locking element halves.

Moreover, the embodiment can advantageously be such that the locking element halves, in a region at a distance from the hinge pin boreholes, are provided with short projections, which are folded over towards the outside and engage arc-shaped openings in the parallel, panel-shaped walls of the receiving part, the radius, measured from the center of the boreholes for the hinge pin, provided in the parallel walls, to the openings being equal to the distance from the center of the boreholes in the locking element halves to the projections folded over towards the outside. The circular measure of the arc-shaped opening thus specifies the maximum pivoting angle of the locking element or the locking element halves, that is, the projections lie in the end positions in each case at one of the ends of the arc-shaped opening.

The boreholes, which are provided in the parallel walls of the receiving part for accommodating the hinge pin for the locking element, are provided at a distance above the transverse wall connecting the parallel walls. Advantageously, this distance is greater than the width of the lug-shaped projection measured between the upper and lower limiting edges. This ensures that the lug-shaped projection, guided on the lower transverse wall, can be inserted into the receiving part and emerges below the hinge pin.

The panel-shaped locking element halves, in turn, can also be connected together through a transverse wall.

The one end of a spring element under compression is then pivotably hinged to the receiving party at a distance above the borehole for the hinge pin of the locking element, while the other end engages the locking element. The compression force, exerted by the spring element on the locking element in the first end position, forces the locking element into the first end position, while the compression force, in the case of the locking element in the second end position, is directed so that the locking element is forced into the second end position.

On the locking element side, the spring element then advisably engages the boundary of the transverse wall, which is averted from the front face and connects the locking element halves.

In an advantageous further development of the invention, an angular projection is provided at the boundary of the transverse wall facing the front face. This angular projection is directed so that, in the first end position of the locking element, it is pivoted between the parallel, panel-shaped walls of the receiving part and, in the second end position, protrudes with its free boundary edge beyond the front face boundary of the panel-shaped walls. If then, during the installation of a front face, the lug-like projection of the holding part is inserted into the receiving part, in which the locking element is in the second end position, the holding part, in a position in which the front face is still at a distance from the end faces of the side walls, comes up against the protruding boundary edge of the angular projection and, as the locking element is pressed in further, turns the locking element in the direction of the first end position. At the same time, the locking element is swiveled through a dead center position and the tension on the spring element then becomes effective in the sense of a swiveling of the locking element into the first end position, the locking edge or edges of the locking element gripping behind the holding edge or edges of the lug-like projection and thus locking the front face in firm contact with the side walls of the drawer.

In order to be able to remove the front faces as easily as possible from the side walls of the drawer, it is advisable to provide in the locking element or optionally in at least one of the locking element halves of the locking element a tool-application recess and, in the region of the walls of the receiving part covering the locking element in the region of the tool-application recess, an opening, which unblocks the tool-application recess for access during the whole of the swiveling process of the locking element from the first into the second end position. For unlocking, the tool, for example, the cutting edge of a screwdriver, is then inserted through the opening into the tool-application recess of the locking element and the locking element is swiveled into the second end position. After the dead center position has been passed, the compression of the spring element automatically forces the locking element into the second end position.

The receiving part, in turn, can be held detachably in a known manner and adjustably in at least two coordinate directions on an assembly component which, in turn, can be fastened at or in the side wall of the corresponding drawer.

BRIEF DESCRIPTION OF THE DRAWINGS

The invention is described in greater detail in the following description of an example and in conjunction with the drawing, in which FIG. 4 shows a side view of the holding part of the metal holding fitting, FIG. 5 shows a view of the holding part, seen in the direction of Arrow 5 of FIG. 4, FIG. 6 shows a sectional view through the holding part, seen in the direction of Arrow 6 in FIG. 4, FIG. 7 shows a side view in the viewing direction of FIG. 2 of the actual receiving part, adjustably held on a two-part assembly component, FIG. 8 shows a plan view seen in the direction of Arrow 8 in FIG. 7.

DETAILED DESCRIPTION OF THE INVENTION

Figure 1:
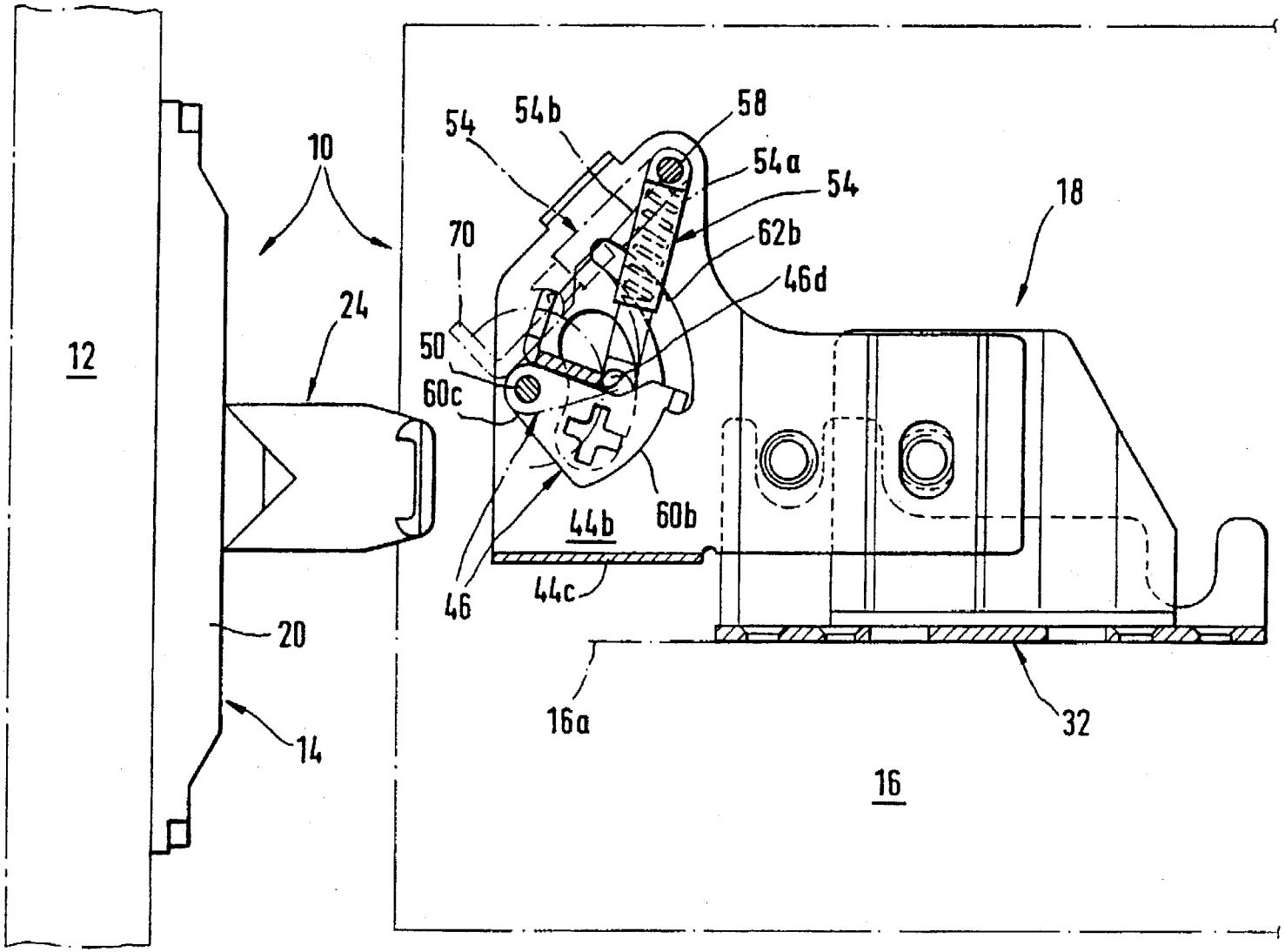
FIG. 1 shows a partially sectional side view of a preferred embodiment of the inventive metal holding fitting in a position, in which the holding part is at a distance from the receiving part.
Figure 2:
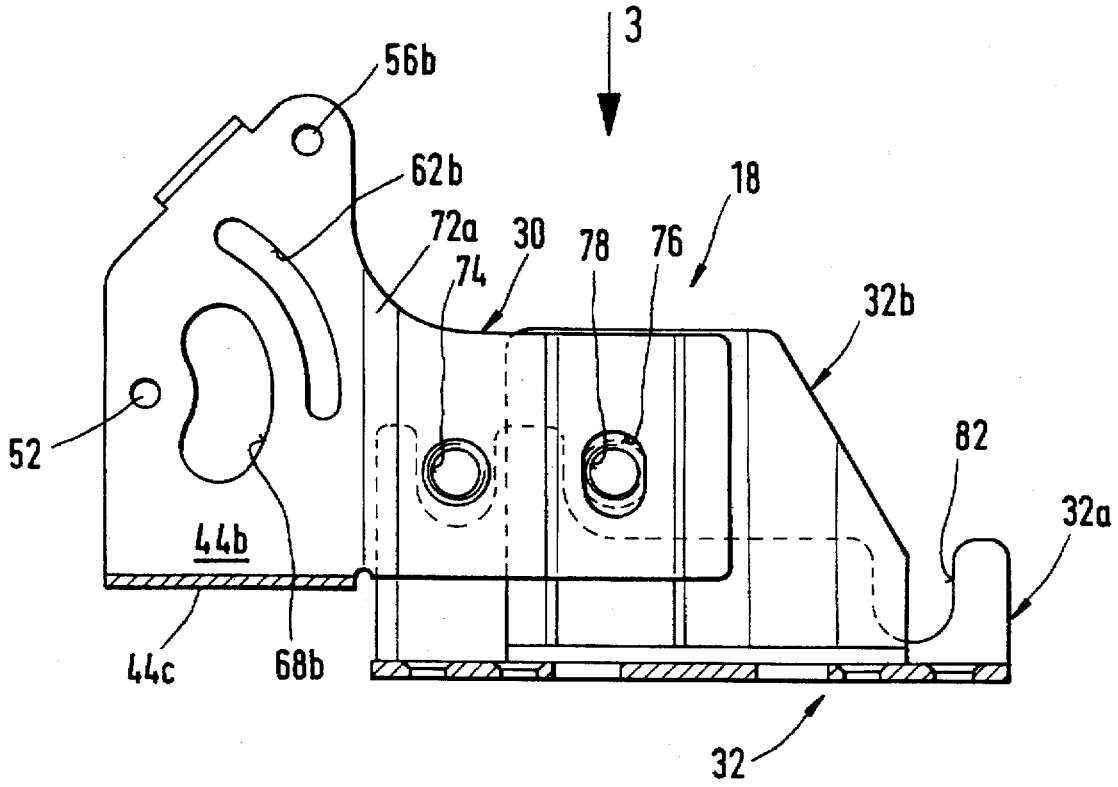
FIG. 2 shows a view, corresponding to that of FIG. 1, of the receiving part of the inventive metal holding fitting without the inserted locking element.
Figure 3:
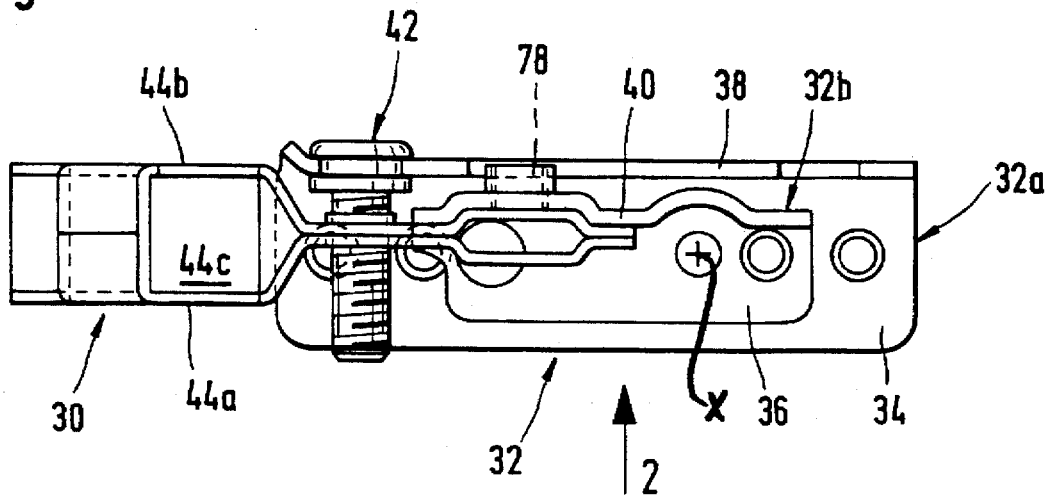
FIG. 3 shows a plan view of the receiving part, seen in the direction of Arrow 3 in FIG. 2.
Figure 9:
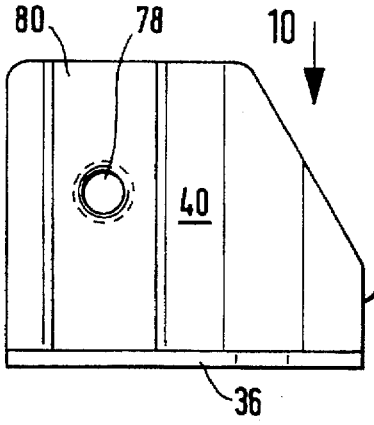
FIG. 9 shows a side view of one of the parts of the two-part assembly components receiving part.
Figure 14:
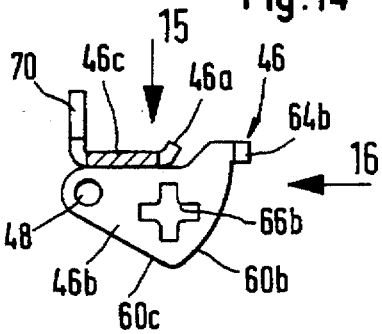
FIG. 14 shows a sectional view through the locking element, pivotably disposed in the receiving part, seen in the direction of the arrows 14–14 in FIG. 15.
Figure 11:
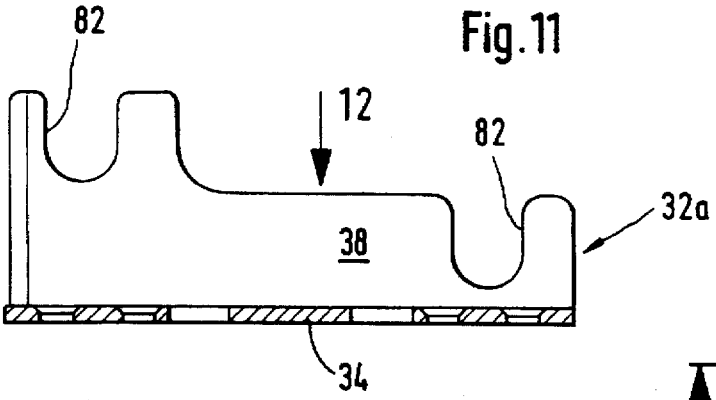
FIG. 11 shows a side view of the second part of the assembly component.
Figure 15:
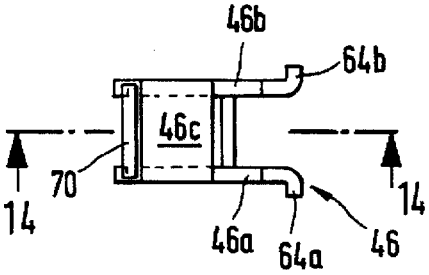
FIG. 15 shows a plan view of the locking element seen in the direction of arrow 15 in FIG. 14
Figure 12:
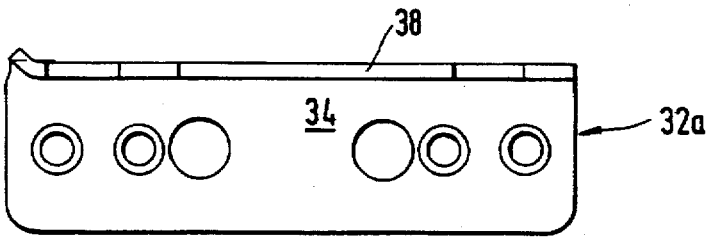
FIG. 12 shows a plan view seen in the direction of Arrow 12 in FIG. 11.
Figure 16:
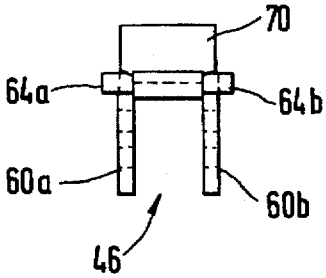
FIG. 16 shows a view of the locking element seen in the direction of Arrow 16 in FIG. 14.

The metal holding fitting for front faces of drawers, which is shown in FIG. 1 and labeled 10 as a whole, consists of two parts, which can be locked together, namely a holding part 14, which can be mounted at the inner surface of a front face 12, which is only indicated in the drawing by dots and dashes, and a receiving part 18, which is also shown only by dots and dashes and is to be mounted in a side wall 16 of a drawer. The holding part is shown separately in FIGS. 4 to 6, while the receiving part is shown in FIGS. 2 and 3. However, a locking element, which is shown separately in FIGS. 14 to 16, is omitted in these Figures.

The holding part 14, which is produced in the special case as a metal die casting, has an extended, narrow, strip-like fastening flange 20, the flat underside of which, facing the front face 12 and functioning as a fastening surface, can be fixed to the inside of the front face by fastening screws, which have not been shown and, passing through fastening boreholes 22, can be screwed into the front face or also by expanding lugs on the inside of the front face, which are also not shown, or can be introduced into assigned blind boreholes in the front face and fixed there to the inside of the front face by expanding studs, which can be fixed by diameter enlargements. Approximately in the center, an integrally cast flat projection 24 protrudes from the side of the fastening flange 20, which flat projection is like a bracket over the greater part of its length and, in side view, tapers somewhat in its free end region and, at the free end, protruding on both sides in opposite directions, has holding lugs 26 which, at their boundary edges, protruding laterally over the flat part of the projection and, pointing rearward to the fastening flange 20, form holding edges 28, the interaction of which with the above-mentioned locking element of the receiving part 18 will be described in the following.

Figure 13:
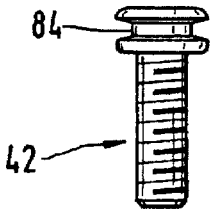
FIG. 13 shows a specially configured adjusting screw, by means of which the receiving part and, with that, the front face can be adjusted in the horizontal direction transversely relative to the assembly component and thus to the side wall of the drawer pressed shut.
Figure 10:
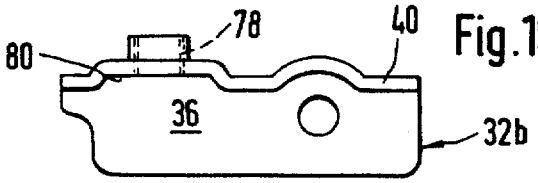
FIG. 10 shows a plan view seen in the direction of Arrow 10 in FIG. 9.

The receiving part 18 (FIGS. 2 and 3), which is to be disposed at or by drawer side walls formed from hollow sections in the hollow interior of the drawer side wall, is composed of the actual receiving component 30 (FIGS. 7 and 8), which is to be connected with the bracket-like projection, and a two-part assembly component 32 (FIGS. 9 and 10 or FIGS. 11 and 12). The two-part assembly component 32 in turn is composed of the lower assembly stand **32*a*, which can be fastened with its fastening flange 34 to a fastening flange 16*a* of the side wall 16 of the drawer, and an upper assembly stand 32*b*, which can be fastened with its fastening flange 36 seated on the fastening flange 34. Both assembly stands 32*a* and 32*b* have assembly walls 38 and 40 respectively, which are folded over at right angles from the respective fastening flanges 34 and 36 respectively. The actual receiving component 30, adjustable in the vertical direction, is fastened to the assembly wall 40 of the upper assembly stand 32*b* and connected by means of the special adjusting screw 42, shown in FIG. 13, in such a manner with the assembly wall 38 of the lower assembly stand 32*a* that, by turning the adjusting screw 42, a horizontal swiveling motion of the two parts 30 and 40 on the fastening flange 34 about the point of rotation "x" is possible and an adjustment of a front face 12**, fastened to a drawer by the invention mental holding fitting, is brought about.

The receiving component 30, is a part, which is stamped out from sheet metal material that originally was flat and then bent into the shape shown in FIGS. 7 and 8, is largely specularly symmetrical about the perpendicular central plane and, in the front face end region, has two parallel, spaced apart, panel-shaped walls **44*a* and 44*b*, which are connected together along their lower boundary edge by an integral transverse wall 44*c*. The clear distance between the walls 44*a* and 44*b* is approximately equal to the width of the bracket-like projection 24 measured over the opposite, free boundary edges of the holding lug 26. The bracket-like projection 24 can thus be introduced between the walls 44*a*** and 44b, being guided at the underside the transverse wall 44c and on both sides at the inner surfaces of the walls 44a and 44b.

In the space between the walls 44a and 44b at a distance above the transverse wall 44c, the locking element 46, shown separately in FIGS. 14 to 16, is pivotably mounted between two end positions, of which the first end position is shown in FIG. 1 in solid lines and the second end position indicated additionally by lines of dots and dashes. The locking element 46 consists of two panel-shaped locking element halves 46a and 46b, which are disposed parallel to and at a distance from one another and the sector-like external boundaries of which can be inferred particularly from FIG. 14. At the upper side, the locking element halves 46a, 46b are connected by a transverse wall 46c into an integral component. At the end region at the left in FIG. 1, flush boreholes 48, through which a hinge pin 50 passes, the ends of which in turn are held in flush boreholes 52 in the walls 44a and 44b, are provided in the locking element halves 46a, 46b. In relation to the transverse wall 44c, the boreholes 52 are offset so far in the upward direction, that the lug-like connection 42 of the holding part 14, during the mounting of the front face 12 at the respectively assigned side wall 16 of the drawer, can be passed between the transverse wall 44c and the hinge pin 50, the locking element 46, which is in the first end position and protrudes into the path of introduction of the lug-like projection 24, is swiveled upward about the hinge pin 50 by the holding lug 26 of the lug-like projection 24 and, moreover, counter to the compressive stress of a spring element, 54 in FIG. 1, the directions of action of the spring force of the spring element 54 in the first and second end position are illustrated in the form of lines of dots and dashes 54a, 54b. It can be seen that these spring forces emanate from the center of flush boreholes 56a, 56b, provided offset in the upward direction in the walls 44a and 44b, and lead to a beveled edge 46d at the boundary edge of the transverse wall 46c of the locking element 46, which is averted from the front face. In the shown embodiment the spring elements is a compressed helical spring the end of which engages on the one hand, a transverse pin 58 that is disposed in the boreholes 56a, 56b, and, on the other, the beveled edge 46d and which is passed through a surrounding telescopic housing to prevent buckling and pivotably engages the transverse pin 58 and the beveled edge 46d. In the region of their end, averted from the front face, that is, pointing to the interior of the drawer, the locking element halves 46a, 46b are provided with boundary edges 60a, 60b which, starting out from a boundary edge 60c, extending obliquely downward in the first end position and protruding into the insertion path of the lug-like projection 24, proceed in such a manner that, on crossing over the end of the oblique boundary edge 60c, they grip behind the holding edges 28 of the holding lugs 26, as a result of which the locking element, initially deflected in the counterclockwise direction by the introduction of the lug-like projection 24, is swiveled by the tension of the above-mentioned spring element once again in the clockwise direction. The boundary edges 60a, 60b are locking edges, the course of which is such that, as the swiveling in the clockwise direction increases, they exert a tightening effect on the holding edge and thus on the lug-like projection 24 and with that also on the holding part 14 and the from face 12. In other words, the front face, after the move of the holding lugs 24 from the oblique boundary edge 60c onto the in each case adjoining locking or boundary edge 60a, 60b, is pulled into clearance-free contact with the facing from edge of the side wall of the drawer and, even in the event of vibrations and the action of high forces acting in the pull-out direction of the drawer, is not loosened, since the locking of the boundary edges 60a, 60b to the holding edges 28 of the holding lugs 26 is self-impeding. In the special example of the embodiment, the course of motion of the boundary edges 60a, 60b of the locking element 46 is shown to be circular. However, it should be pointed out that the center of the radius of these arcs does not lie on the longitudinal central axis of the hinge pin 50, but should be thought of as being displaced far in the upward direction with respect to this, as a result of which the described tightening, when the lug-like projection is being locked, is achieved.

In the walls 44a, 44b of the receiving component 30, arc-shaped opening 62a, 62b are provided, which are engaged by projection 64a, 64b, which are provided at the locking element halves 46a, 46b, and are folded over to the outside. The center of the radius of the arc-shaped openings 62a, 62b, coincides with the longitudinal central axis of the hinge pin 50, so that the locking element 46 can be swiveled within the confines of the arc length of the arc-shaped openings. The projection 64a, 64b form the boundary of the path of swiveling of the locking element 46 to a radian measure corresponding to the radian measure of the arc-shaped openings. The projections then lie against the respective ends of the arc-shaped openings and prevent further swiveling. On the basis of the above description and in conjunction with the representation of the locking element 46 in the two end positions in FIG. 1, it can now be recognized that the locking element 46 is acted upon by the spring element in such a manner, that it is bistable, that is, so that, in the first end position, the projections 64a, 64b in each case lie against the lower end of the arc-shaped openings 62a, 62b while, in the second end position, they lie against the upper end of the opening. This is accomplished owing to the fact that the directions of action 54a, 54b of the spring element change during the swiveling of the locking element from the first into the second position in such a manner, that they lie on different sides of the line connecting the hinge pin 50 with the transverse pin 58. Accordingly, it is possible to transfer the locking element 46 into a stable unlocking position by deliberately swiveling it up into the second end position. This is necessary if the front face 12 is to be removed again from the side wall 16 of the drawer. In order to make it possible to swivel the locking element 46 up, a tool-application recess, constructed in the case shown as a continuous cross slot 66a, 66b is provided in the locking halves 46a, 46b and, in the walls 44a, 44b, the region of the wall above these cross slots 66a, 66b is uncovered by appropriately shaped openings 68a, 68b. It is thus possible to introduce the end of a Phillips screwdriver into one of the cross slots 66a, 66b and then swivel the locking element with the Phillips screwdriver up into the second stable end position.

At the boundary of the transverse wall 46c of the locking element 46 facing the front face, an angular projection 70 is provided, which lies between the walls 44a, 44b in the first end position, but has the position, which can be recognized by the lines of dots and dashes in FIG. 1 in the second end position, in which the projection 70 protrudes from the front boundary of the walls 44a, 44b. When the lug-like projection 24 is introduced into the receiving component 30, the free end of this angular projection comes to lie against the fastening flange 20 of the holding part 14 in a particular position in front of the actual locking position. As the lug-like projection 24 is pushed in further, the angular projection is necessarily forced back between the walls 44a, 44b, as a result of which the locking element 46 is swiveled in the clockwise direction. After passing through a dead center position, the compression of the spring element causes the locking element to swivel in the clockwise direction and the locking of the boundary edges 60*a*, 60*b* at the holding edges 28 of the holding lug 26 takes place automatically at the instant, in which the holding edges pass over the lower end of the boundary edge 60*c* of the locking element halves 46*a*, 46*b*.

For holding the assembly component 32 adjustably, the walls 44*a*, 44*b* are extended at their ends, which are averted from the front face, to form an assembly extension 72, which consists of transition sections 72*a*, cut at the walls and extending obliquely until they contact one another, and of fastening sections 72*b*, which adjoin the transition section 72*a* and essentially lie against one another and are connected to one another. In the front region of the fastening section 72*b* immediately adjoining the oblique transition section 72*a*, a threaded borehole 74 is provided, into which the threaded shaft of the already mentioned adjusting screw 42 is screwed. Offset further into the interior of an assigned drawer side wall 16, a guide section 72*c*, protruding in strip fashion on both sides of the assembly extension, is formed by appropriate, multiple, vertical tilting in the fastening sections. In this guide section 72*c* a vertical, extended hole opening 76 is provided, which permits a vertical adjustment of the receiving part relative to the mounting member, when the assembly extension 72 is screwed onto the assembly wall 40 of the upper assembly stand 32*b*. In the assembly wall 40 of the assembly stand 32, a threaded borehole 78 is provided for this purpose, into which the threaded shaft of a fastening screw, which is not shown and the head of which presses the assembly extension 72 into clamping contact with the assembly wall 40, can be screwed. By means of a trough-like depression 18 in the assembly wall 40, shaped to compliment the protruding guiding section 72*c*, the vertical alignment of the assembly extension 72 on the assembly wall 40 is ensured. In this connection, the fastening flange 36 of the upper assembly stand 32*b* is seated on the fastening flange 34 of the lower assembly stand 32*a* and both fastening flanges 34, 36 are fastened to the fastening surface 16*a* in the drawer side wall. The fastening can be realized in such a manner that the receiving part can be adjusted as a whole in the horizontal direction at right angles to the inner surface of the front face 12.

An assembly wall 38, which has open, vertical, slot-like recesses 82 at the upper side in both end regions, protrudes from a longitudinal edge of the fastening flange 34 of the lower assembly stand at a distance from and parallel to the assembly wall 40. In the specified, installed position of the receiving component on the mounting member 32, the slot-like recess 82, which is closer to the front face, is aligned to the threaded borehole 74 in the fastening section 72*b*. The diameter of the head of the adjusting screw 42, which is screwed with its threaded shaft into the threaded borehole 74, is larger than the width of the slot-like recess 32. In the peripheral surface of this head, a circulating group 84 is cut, the width of which is approximately equal to or slightly larger than the thickness of the material of the fastening flange 38. The head of the fastening screw can thus be introduced through the end, which is open at the top, into the slot-like recess. The opposite walls, which form the groove, lie on both sides against the boundaries of the slot-like recess of the fastening flange 38. If now the adjusting screw 32 is turned, the depth to which its threaded shaft is screwed into the threaded borehole 72 is changed. However, since the position of the head in slot-like recess 82 of the fastening flange 38 is fixed, the assembly extension 72 is necessarily pulled in the direction of the fastening flange 38 or forced away from it depending on the direction of rotation of the adjusting screw. The aforementioned horizontal adjustment of the front face 12 can be realized in this manner.

We claim:

1. A metal fitting for holding a front face of a drawer to side walls of the drawer said front face having an outer surface and an inner surface, said fitting comprising;

a holding part, fastenable to inner surface of the drawer front face and having a bracket-like projection projecting substantially rectangularly from the inner surface, said bracket-like projection being insertable into a receiving part, a receiving part, fastenable to a side wall of the drawer, for detachably receiving the bracket-like projection, a locking element for locking said bracket-like projection after insertion into the receiving part, said locking element being movably attached to the receiving part and acted upon by a spring element under tension such that the locking element can be rotated about an axis between a first and second stable, end-position in a region facing the drawer front face, and extending transversely to an inserting direction of the extended projection, wherein said locking element is provided with at least one locking edge on an end region, and, as a result of tension by the spring on the locking element, is rotated into the first end position in a specified mounting position of the front face, behind a holding edge formed in a free end region of the bracket-like projection, said holding edge pointing rearward toward the front face, said locking element further comprising a limiting edge, adjoining an end of the locking edge, and protruding, in the first end position of the locking element, into the insertion path of the bracket-like projection, said limiting edge being configured to collide with the free end region of the bracket-like projection during the insertion of the bracket-like projection into the receiving part, said collision causing the locking element to rotate against the spring under tension in the direction of the second stable end position, and wherein the locking edge of the locking element, while being rotated behind the holding edge of the bracket-like projection, has an increasingly greater distance from the axis of rotation of the locking element in the region of contact with the holding edge, and wherein the locking edge further comprises an arched course having a radius, measured from the axis of rotation of the locking element to the locking edge, increases gradually from a first end, which at first grips behind the holding edge during the locking process, in the direction of the other end, and wherein the bracket-like projection further comprises holding lugs on both sides at the free end, which protrude in opposite directions, and on said holding lugs are constructed holding edges for the locking element, and said locking element further comprises two panel-shaped locking element halves having a common outer boundary, said locking element halves being disposed parallel to and at a distance from each other, and, accordingly, two locking edges having the same course, the clear distance of which from one another is at least equal to the thickness of the bracket-shaped projection, but smaller than the distance measured over the opposite, free, boundary edges of the holding lugs.

2. The metal holding fitting according to claim 1, wherein, in its end region at the front face end region, the receiving part has two panel-shaped walls, which are disposed parallel to and at a distance from one another and the clear distance of which from one another is at least equal or somewhat greater than the distance measured over the opposite free boundary edges of the holding lugs of the lug-shaped projection, and in that the parallel, panel-shaped walls are connected together at their underside by a transverse wall provided for guiding the bracket-shaped projection, and in that the locking element, by means of a hinge pin passing through flush boreholes in the parallel walls and in the locking element halves is pivotably mounted in the space between the parallel walls.

3. The metal holding fitting according to claim 2, wherein the locking element halves, in a region at a distance from the hinge pin boreholes, are provided with short projections, which are folded over towards the outside and engage arc-shaped openings in the parallel, panel-shaped walls of the receiving part, the radius, measured from the center of the boreholes for the hinge pin, provided in the parallel walls, to the openings being equal to the distance from the center of the boreholes in the locking element halves to the projections folded over towards the outside.

4. The metal holding fitting according to claim 2, wherein the boreholes, which are provided in the parallel walls of the receiving part for accommodating the hinge pin for the locking element, are provided at a distance above the transverse wall connecting the parallel walls, which distance is greater than the width of the lug-shaped projection measured between the upper and lower limiting edge.

5. The metal holding fitting according to claim 2, wherein, in at least one of the locking element halves of the locking element, a tool-application recess is provided and in that, in the region of the walls of the receiving part covering the locking element in the region of the tool-application recess, an opening is provided, which unblocks the tool-application recess for access during the whole of the swiveling process of the locking element from the first into the second end position.

6. The metal holding fitting according to claim 1, wherein the panel-shaped locking element halves are connected together by a transverse wall, and the spring element engages the boundary of the transverse wall, which is averted from the front face and connects the locking element halves.

7. The metal holding fitting according to claim 6, wherein, at the boundary of the transverse wall facing the front face, an angular projection is provided, which is directed so that, in the first end position of the locking element, it is pivoted between the parallel, panel-shaped walls of the receiving part and, in the second end position, protrudes with its free boundary edge beyond the boundaries on the front face side of the panel-shaped walls.

8. The metal holding fitting according to claim 1, wherein an end of the spring element under compression is pivotably hinged to the receiving part at a distance above the borehole for a hinge pin of the locking element, while another end engages the locking element, and the compression force exerted by the spring element on the locking element in the first end position, forces the locking element into the first end position, while the compression force, when the locking element is in the second end position, is directed so that the locking element is forced into the second end position.

9. The metal holding fitting according to claim 1, wherein the receiving part can be held detachably in a known manner and adjustably in at least two coordinate directions on an assembly component which, in turn, can be fastened at or in the side wall of the corresponding drawer.

* * * * *